US008556194B2

(12) United States Patent
Mieney et al.

(10) Patent No.: US 8,556,194 B2
(45) Date of Patent: Oct. 15, 2013

(54) FUEL INJECTOR

(75) Inventors: Harry R. Mieney, Byron, NY (US); Michael Raymond Raney, Mendon, NY (US); Michael Raymond Salemi, Rochester, NY (US); Robert B. Perry, Leicester, NY (US)

(73) Assignee: Delphi Technologies, Inc., Troy, MI (US)

( * ) Notice: Subject to any disclaimer, the term of this patent is extended or adjusted under 35 U.S.C. 154(b) by 662 days.

(21) Appl. No.: 12/821,475

(22) Filed: Jun. 23, 2010

(65) Prior Publication Data

US 2011/0315795 A1 Dec. 29, 2011

(51) Int. Cl.
*F02M 51/00* (2006.01)

(52) U.S. Cl.
USPC ..... 239/585.1; 239/585.4; 239/900; 251/129.15

(58) Field of Classification Search
USPC ..... 239/585.1, 585.4, 585.5, 900; 251/129.15, 129.21
See application file for complete search history.

(56) References Cited

U.S. PATENT DOCUMENTS

| | | | | |
|---|---|---|---|---|
| 6,742,726 | B2 * | 6/2004 | Reiter | 239/585.1 |
| 6,745,993 | B2 * | 6/2004 | Mueller | 239/585.1 |
| 7,506,827 | B2 | 3/2009 | Petrone et al. | |
| 2006/0163390 | A1 * | 7/2006 | Ruehle et al. | 239/585.5 |

OTHER PUBLICATIONS

Brauer, Considering Electromagnetic Delays, Motion System Design, May 11, 2010, http://motionsystemdesign.com/sensing-control/considering-electromagnetic-delays-0909/.

Brauer, Toward the Instant-On Actuator, Machine Design by Engineers for Engineers.com, Jul. 27, 2006, http://machinedesign.com/article/toward-the-instant-on-actuator-0727.

Brauer, Equivalent Resistor for Nonlinear Magnetic Diffusion in Electromechanical and Electrohydraulic Systems Models, Automotive Electromechanical Simulation Workshop, Detroit, MI Oct. 9, 2003.

* cited by examiner

*Primary Examiner* — Steven J Ganey
(74) *Attorney, Agent, or Firm* — Lawrence D. Hazelton

(57) ABSTRACT

A fuel injector that includes a flying armature movable relative to a pintle stop, and an electromagnetic circuit configured to move the flying armature away from the pintle stop prior to accelerating the armature toward the pintle stop as part of moving the pintle to open the fuel injector. The flying armature increases the total force applied to the pintle to open the fuel injector by supplementing the static force imparted to the armature by a magnetic field with an impact force imparted by the armature being in motion toward and impacting with the pintle stop. The arrangement of magnetic circuit devices and materials used to make the magnetic circuit devices cooperate to provide a reversing force that urges the armature away from before urging the armature toward the pintle stop, and increases the rate at which the force that urges the armature toward the pintle stop increases.

15 Claims, 4 Drawing Sheets

FUEL INJECTOR

TECHNICAL FIELD OF INVENTION

The invention generally relates to a fuel injector, and more particularly relates to increasing the maximum fuel pressure capability of an electro-magnetically actuated fuel injector.

BACKGROUND OF INVENTION

Many electro-magnetic type fuel injectors include a spring that urges a pintle/ball assembly against a nozzle seat to prevent fuel from flowing from the injector when the injector is OFF. When a current is applied to a coil winding within the fuel injector, a magnetic field is generated that urges the pintle/ball assembly away from the nozzle seat and thereby turns the injector ON. In general, the amount of force needed to lift a pintle/ball assembly from the injector OFF or closed position to the injector ON or open position is proportional to a spring load and rate of the spring plus a fuel pressure of the fuel present in the injector. However, some direct injection fuel systems have increased fuel pressures to a level where it becomes difficult to provide a fuel injector that has the same physical outline or package size as injectors designed for lower fuel pressure levels, and is able to reliably 'dead lift' the pintle/ball assembly at the higher fuel pressure levels.

It has been proposed to add a sliding or flying armature that, in response to the magnetic field, accelerates and then strikes a pintle stop like a slide hammer to provide a combination of kinetic energy and static force to lift the pintle/ball assembly off the nozzle seat. It has also been proposed to include an armature spring to urge the armature away from the pintle stop so that for each injection event the armature consistently has the greatest distance to accelerate before striking the pintle stop. However, the addition of this armature spring undesirably increases the cost and complexity of the fuel injector and reduces the performance of the injector with regard to pintle opening rate and pintle opening delay.

SUMMARY OF THE INVENTION

In accordance with one embodiment of this invention, fuel injector includes a pintle, an armature, and an electromagnetic circuit. The pintle is movable to a closed position that prevents fuel flow from the fuel injector, and to an open position that allows fuel flow from the fuel injector. The armature is movable between a first stop and a second stop. The armature is slideably coupled to the pintle such that the armature contacts a pintle stop as the armature is urged from the first stop to the second stop to urge the pintle toward the open position. The pintle is free to move to the closed position when the armature is not urged toward the second stop. The electromagnetic circuit includes the armature, a first magnetic circuit device, a second magnetic circuit device, and a coil configured to generate a magnetic field in response to a coil current. The electromagnetic circuit is arranged such that the magnetic field is present between the first magnetic circuit device and the second magnetic circuit device. The arrangement is also such that magnetic field between the first magnetic circuit device and the second magnetic circuit device passes through the armature. The first magnetic circuit device, the second magnetic circuit device, and the armature are configured so that the magnetic field urges the armature toward the first stop during a time period following the initialization of the coil current, and urges the armature toward the second stop following the time period. By exhibiting this characteristic, a static force arising from the magnetic field acting on the armature and an impact force arising from the armature impacting the pintle stop while moving toward the second stop cooperate to generate a pintle opening force effective to overcome a pintle closing force and thereby move the pintle from the closed position to the open position.

Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

The present invention will now be described, by way of example with reference to the accompanying drawings, in which.

DETAILED DESCRIPTION OF INVENTION

Figure 1:
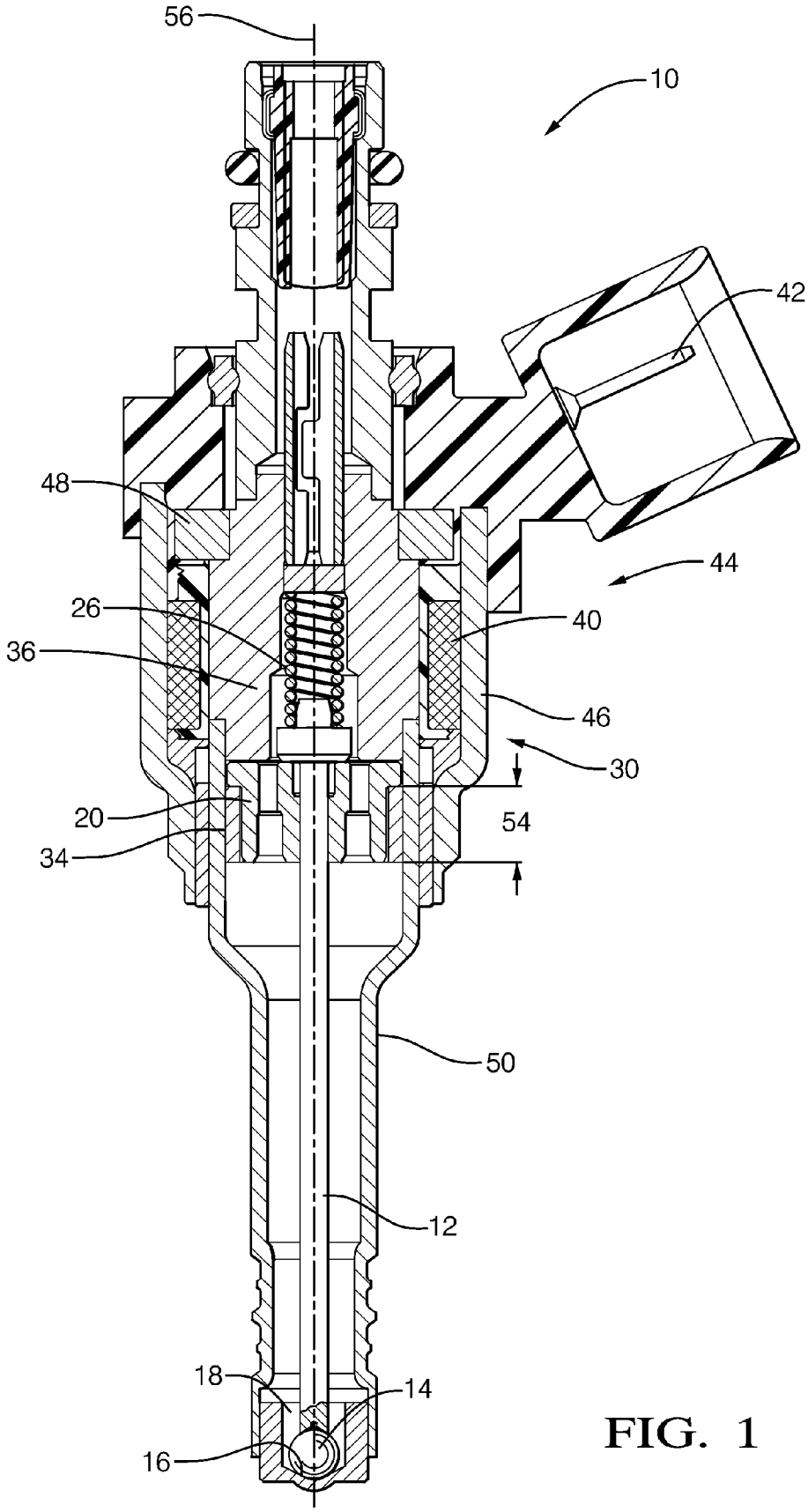
FIG. 1 is cross sectional view of a fuel injector in accordance with one embodiment.
Figure 2A:
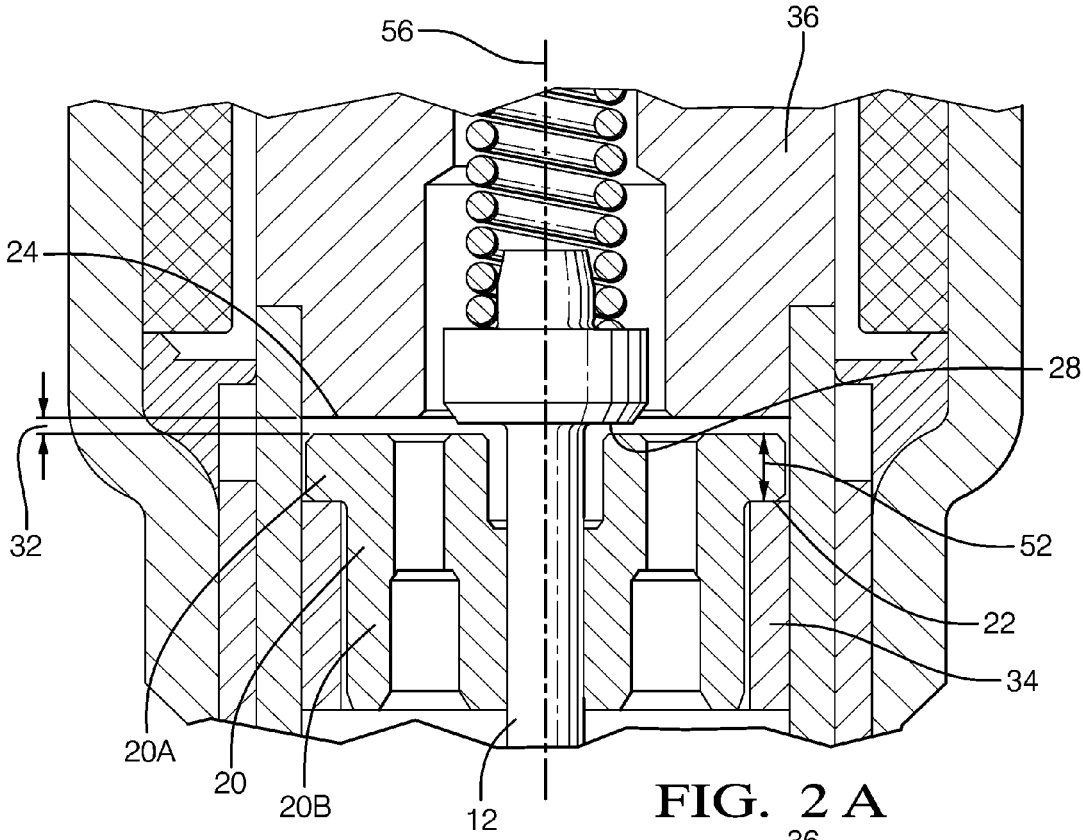
FIG. 2 is a close-up view showing details of the fuel injector in FIG. 1 at different operating conditions.
Figure 2B:
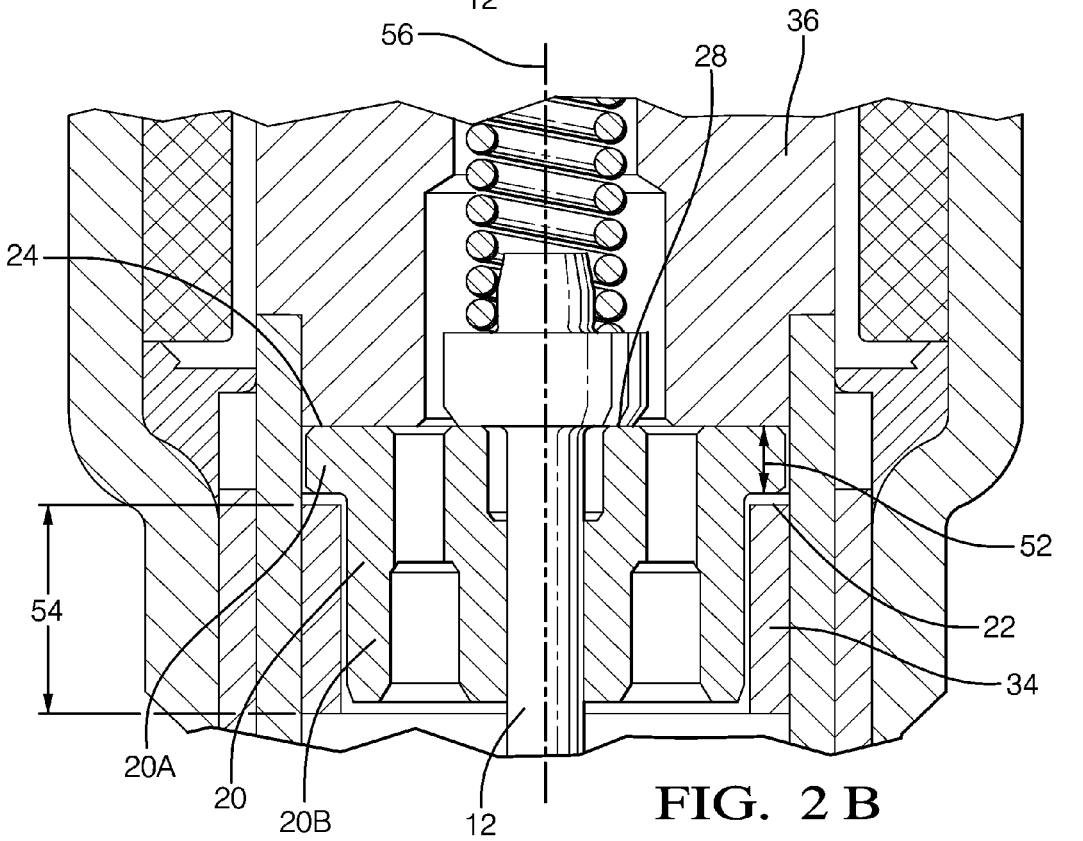

In accordance with an embodiment of a fuel injector for an internal combustion engine, FIG. 1 illustrates a fuel injector 10. In general, the injector 10 has a pintle 12 that may include a ball 14 or other feature configured to cooperate with a seat 16 to regulate the flow of fuel 18 from within the injector to be dispensed by the injector 10. FIG. 2A shows the pintle 12 after moving into a closed position that positions the ball 14 in contact with the seat 16 to prevent fuel 18 from flowing out of injector 10. FIG. 2B shows the pintle 12 after moving into an open position so the ball 14 can be apart from the seat 16 to allow fuel 18 to flow from the fuel injector 10.

The injector 10 may also include an armature 20 movable between a first position against a first stop 22 as illustrated in FIG. 2A, and a second position against a second stop 24 as illustrated in FIG. 2B. As will be explained in more detail later, the armature 20 may be urged toward either the first stop 22 or the second stop 24 by a magnetic field that is generally directed toward or through at least a portion of the armature 20 for moving the armature 20 between the first stop 22 and the second stop 24. The armature 20 may be slideably coupled to the pintle 12 such as illustrated in FIG. 1 where the armature 20 surrounds a portion of the pintle 12 and slides along that portion. The pintle 12 and the armature 20 may be configured so that the armature 20 contacts a pintle stop 28 as the armature 20 moves from a position near the first stop 22 toward the second stop 24. If the armature is being urged toward the second stop 24, then the contact with the pintle stop 28 will act to urge the pintle 12 toward the open position. When the armature 20 is against the second stop 24, then the pintle 12 is generally considered to be in the open position. The armature 20 may also be slideably coupled to the pintle 12 such that the pintle 12 is free to move to the closed position when the armature 20 is not in contact with the second stop 24 and the pintle stop 28 or when the armature 20 is at or near the first stop 22.

The injector 10 may include an electromagnetic circuit 30 that includes the armature 20 arranged proximate to the second stop 24 to define an air gap 32 having a gap size that depends on the position of the armature 20 relative to the second stop 24. In one embodiment the shape of the armature 20 or the second stop 24 may be such that the air gap 32 has distinct regions that have different distances separating the armature 20 from the second stop 24. For example, when the armature 20 contacts the second stop 24 as shown in FIG. 2B, part of the gap 32 has no distance because of the contact with the second stop 24, and part of the gap 32 has a distance due to the shape of the second stop 24 and the armature 20. The electromagnetic circuit 30 may also include a first magnetic circuit device 34 formed of a first material and a second magnetic circuit device 36 formed of a second material that may or may not be distinct from the first material. As will be explained in more detail below, the shapes and sizes of the various magnetic circuit devices, and the materials used to form these devices may be selected to have certain features that in response to initiating a magnetic field leads to the armature 20 being urged in one direction for a period of time followed by the armature 20 being urged in the opposite direction. The electromagnetic circuit 30 may also include a coil 40 configured to generate the magnetic field in response to a coil current arising from a voltage being applied to first and second connector pins 42. While FIG. 1 only shows one connector pin, it will be appreciate that at least two electrical connections are necessary to generate current in the coil 40.

When a coil current arises following the application of a voltage to the coil 40, a magnetic field may be generated between the first magnetic circuit device 34 and the second magnetic circuit device 36 that passes through the armature 20 and the air gap 32. It has been observed that for some configurations of the first magnetic circuit device 34, the second magnetic circuit device 36, and the armature 20 that the magnetic field initially urges the armature toward the first stop during a time period, and then urges the armature toward the second stop following the time period. When the armature 20 makes contact with the pintle stop 28, a static force arising from the magnetic field acting on the armature 20 may act on the pintle 12 to urge it to the open position. In addition, when the armature 20 makes contact with the pintle stop 28 while the armature moves toward the second stop 24, an impact force arising from the speed of the armature 20 at the moment of impact with the pintle stop 28 may combine cooperatively with the static force to generate a pintle opening force greater than either the static force or the impact force alone. Such a combination of forces may be effective to overcome a pintle closing force and thereby move the pintle 12 from the closed position to the open position. In other words, following the application of a coil current to the coil 40, the armature is first driven in one direction for a time period and then driven in the opposite direction following the time period so the impact of the armature 20 on the pintle stop 28 acts like a slide hammer striking the pintle stop 28 to help overcome the forces holding the pintle 12 in the closed position.

While not subscribing to any particular theory, it is believed that the time it takes for a magnetic field to establish lines of magnetic flux in a magnetic devices such as the first magnetic circuit device 34, the second magnetic circuit device 36 and the armature 20, combined with the time it takes each component to become saturated, is at least in part dependent on the shape of the component and the material used to form the component. By way of a non-limiting example, if the materials and shapes are selected so the first magnetic circuit device 34 becomes magnetically saturated faster than the second magnetic circuit device 36, then following initiating a coil current in the coil 40, the armature 20 may be initially be urged or drawn toward the first magnetic circuit device 34. As the first magnetic circuit device 34 becomes magnetically saturated, the flux density in the second magnetic circuit device 36 may continue to increase until the flux density from the second magnetic circuit device 36 is greater than the flux density from the first magnetic circuit device 34, and so the armature is then urged or drawn toward the second stop 24. As such, the materials, and shapes of devices 34 and 36, and armature 20 may be selected so the armature 20 is urged in opposite directions at different times relative to the time of coil current being initiated, and also be selected based on the pintle closing force that needs to be overcome to open the fuel injector 10.

Figure 3:
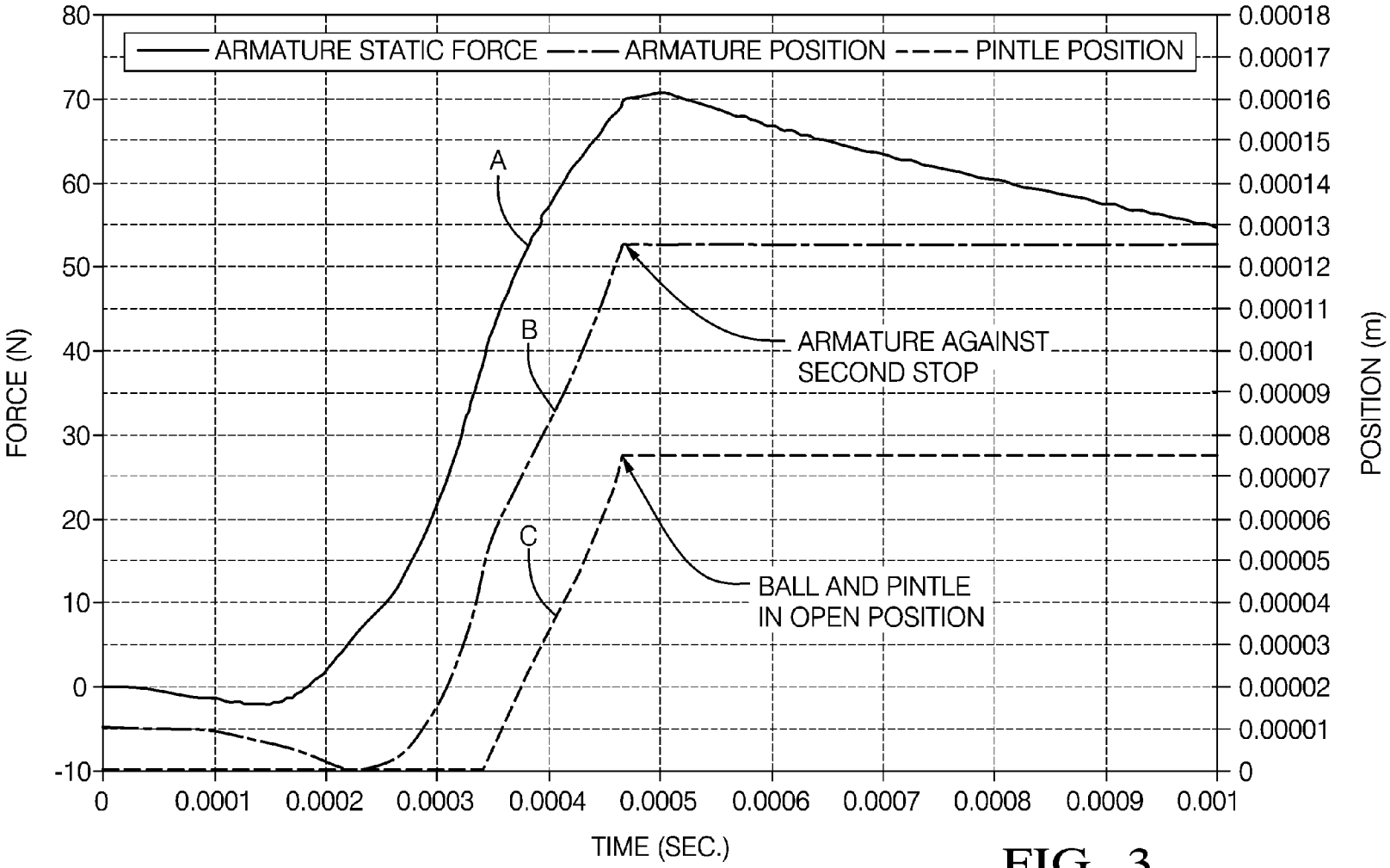
FIG. 3 is a graph of operating characteristics of the fuel injector of FIG. 1, in accordance with one embodiment.

FIG. 3 illustrates functional characteristics for fuel injector 10 that were generated using Simplorer transient magnetic modeling. Referring to FIGS. 1 and 2, the first stop 22, the second stop 24, and the armature 20 are arranged such that the armature 20 can travel about 145 micrometers (um) between the stops 22 and 24. The pintle stop 28 is located such that the armature 20 makes contact with the pintle stop 28 at a position between the first stop 22 and the second stop 24. The contact location is selected based on a compromise of providing the greatest distance for the armatures 20 to accelerate toward the pintle stop 28, and the distance the pintle 12 and ball 14 need to move away from the seat 16 to allow an adequate flow of fuel 18 from the injector 10. As illustrated in FIG. 3, the initial position of the armature was selected at 10 um away from the first stop 22. Such a value is believed to be representative of an armature in a fuel injector 10 operating in an internal combustion engine where the initial armature position may only be influenced by gravity, but not a spring. In this case, vibration may cause an average position that is not zero, i.e.—not in constant contact with the first stop 22. Since the position of pintle 12 is biased toward the closed position by the spring 26, the initial pintle position is set at zero.

At time zero (0), a voltage is applied to the coil 40 and characteristics arising in response to the magnetic field generated are recorded. Curve A illustrates the force applied to the armature as being negative until about 190 microseconds (us), after which the force is indicated as positive. Accordingly, the armature 20 initially moves toward the first stop 22, possibly contacting it, and then changes directions at about 220 us and begins to move toward the second stop 24. The speed of the armature at any time is generally indicated by the slope of the armature position illustrated by Curve B. At about 350 us the armature 20 makes contact with the pintle stop 28 and so the pintle begins to move toward the open position. At about 470 us the armature 20 contacts the second stop 24 and so the armature 20 and the pintle 12 stop moving. After this time the pintle is in the open position and so fuel is being dispensed by the injector 10.

Simplorer models of previous fuel injector designs do not show the negative force applied to the armature 20 and so accordingly do not show the armature 20 moving toward the first stop 22 prior to moving toward the pintle stop 28. Simplorer models also indicate that the embodiment illustrated in FIGS. 1 and 2 has delayed the armature movement until the flux density in the magnetic circuit is more fully developed, thereby increasing the slew rate or rate of rise of the electromagnetic force, i.e.—increased the slope of the electromagnetic force Curve A when compared to prior injector designs that do not exhibit this characteristic. This increased rate of rise provides for increased armature speed, and so increases the impact force of the armature on the pintle so as to provide increased pintle opening rate, and reduced pintle opening delay.

It will be appreciated that for an electromagnetic actuator such as the fuel injector 10 described herein to operate effectively, it will be preferable for the first material, the second material, and the third material to each have a permeability substantially greater than air. The materials selected may have other material properties to be suitable choices for use in a fuel injector. Such other properties may include, but are not limited to, corrosion resistance, mechanical strength, and formability; as well characteristics useful to optimize a pintle opening rate. As such, in one embodiment the first material may be four hundred (400) series martensitic stainless steel, the second material may be twelve percent (12%) chrome ferritic stainless steel, and the third material may be twelve percent (12%) chrome ferritic stainless steel. Alternately, the first material may be twelve percent (12%) chrome ferritic stainless steel. However, as will be explained below, it may be advantageous for the first magnetic circuit device 34 to be formed of a material that is ferromagnetic, such as be four hundred (400) series martensitic stainless steel.

Figure 4:
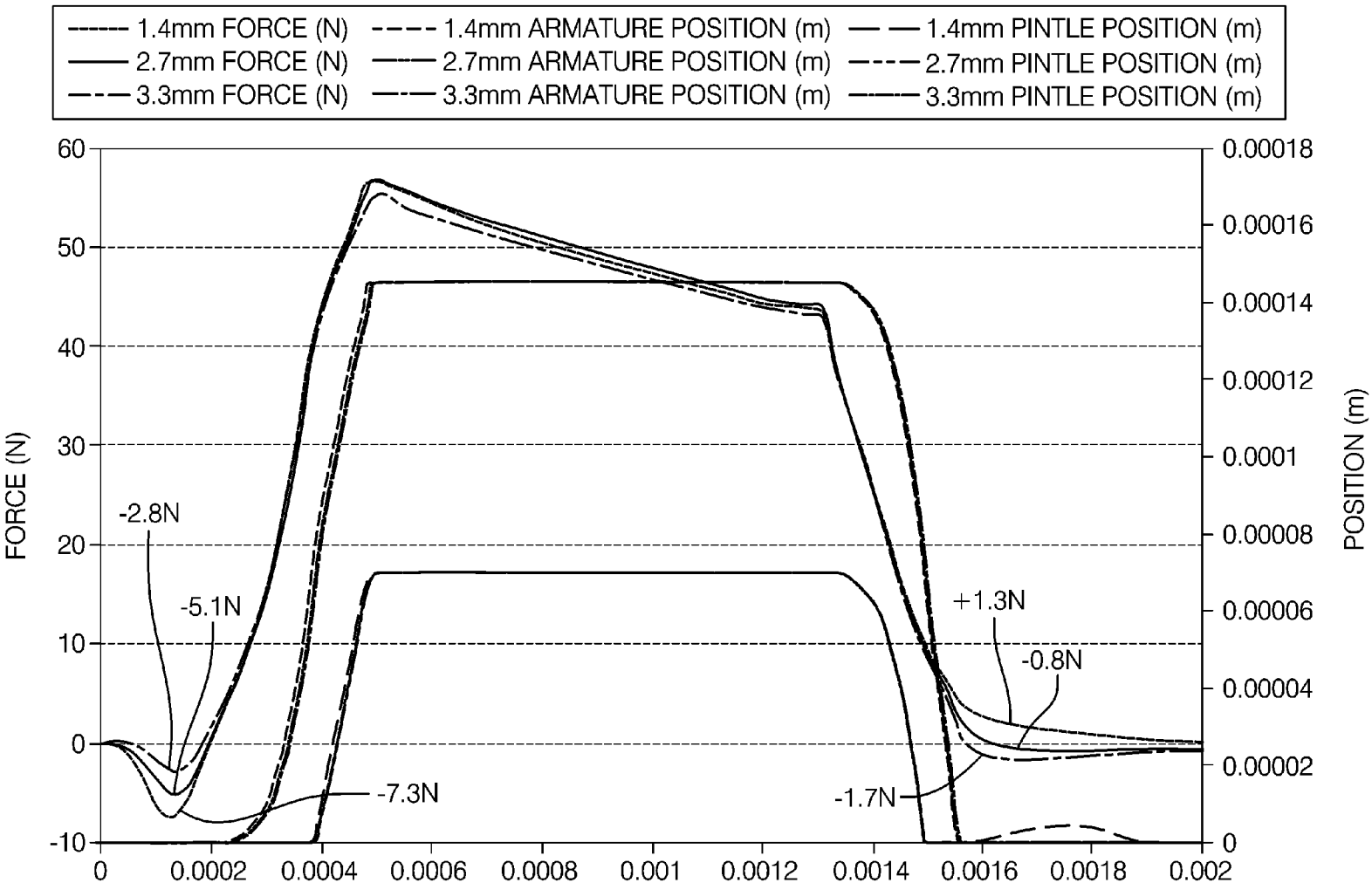
FIG. 4 is a graph of operating characteristics of the fuel injector of FIG. 1, in accordance with three embodiments.

As suggested above, the armature shape may be varied to influence the maximum operating fuel pressure (MOP), to optimize the pintle opening rate, or other fuel injector performance characteristic of the fuel injector 10. In the exemplary embodiment shown in FIGS. 1 and 2, the armature 20 may include a main portion 20B slideably guided by the pintle 12, and a radial extension portion 20A extending toward a housing 44. The radial extension portion may be generally located between the first magnetic circuit device 34 and the second magnetic circuit device 36. The radial extension portion 20A may be characterized by an extension longitudinal length 52. FIG. 4 illustrates various functional characteristics similar to those shown in FIG. 3 for injectors having extension longitudinal length values of 1.4 mm, 2.7 mm, and 3.3 mm. As can be seen from the graph, varying the extension longitudinal length 52 affects the force applied by the magnetic field to the armature 20. As such, it will be appreciated that the extension longitudinal length 52 may be adjusted to select a desired force by the magnetic field urging the armature toward the first magnetic circuit device both before opening the injector 10, see graphs prior to about 0.0002 seconds, and after closing the injector 10, see graphs at about 0.0016 seconds.

In one embodiment the first stop 22 may be provided by the first magnetic circuit device 34 and the second stop 24 may be provided by the second magnetic circuit device 36, as illustrated in FIGS. 1 and 2. Such an arrangement simplifies the assembly of the fuel injector 10 by reducing the number of parts required to fabricate the fuel injector 10. The fuel injector 10 may also include a housing 44 that defines a longitudinal axis 56, and the first magnetic circuit device may be a ring fixedly attached to the housing and coaxial with the longitudinal axis 56, said ring having a ring length 54 selected based on the pintle closing force. In view of FIGS. 3 and 4 and the description above with regard to the extension longitudinal length 52, it will be appreciated that the injector performance characteristics such as MOP may be influenced by varying the shape and materials used to form other magnetic circuit devices that are part of the electromagnetic circuit 30. The injector performance may be further influenced by, for example, varying a ring length 54 of the first magnetic circuit device 34. In the exemplary embodiment in FIG. 1, the first magnetic circuit device 34 may be generally described a stop ring that also provides a surface that serves as the first stop 22 for the armature 20.

Similarly, the second magnetic circuit device 36 may be generally described as a pole piece that also provides a surface that serves as the second stop 24 for the armature. The housing 44 may encompass other parts such as the pintle 12, which may be coaxial with the longitudinal axis 56. For a first magnetic circuit device 34 in the form of a stop ring, the ring may be fixedly attached to the housing and coaxial with the longitudinal axis. The housing 44 may include a solenoid housing 46 and a flux washer 48 that form part of the electromagnetic circuit 30, and a lower housing 50 that couples the seat 16 to the solenoid housing 46, and may also be part of the electromagnetic circuit 30. As such, it will be appreciated that the materials used to form the solenoid housing 46, the flux washer 48, and the lower housing 50 may selected based on physical material properties such as corrosion resistance, mechanical strength, and formability, as well as be selected to optimize a pintle opening rate or other magnetic related performance characteristic that influence the performance of the fuel injector 10, such as the maximum fuel pressure that the fuel injector 10 will reliably operate.

It will be appreciated that the rate that the current changes from no current to some current value may also affect the magnitude and duration of the force urging the armature toward the first stop 22 prior to the force changing direction and urging the armature 20 toward the second stop 24. It has been observed that the first material, the second material, and the armature shape may be selected to optimize the armature speed at the time of impact and the opening speed of the pintle 12, and so reduce the occurrence of failing to open because the closing force applied to the pintle 12 by high pressure fuel cannot be overcome. It has also been observed that such optimization also reduces opening delay, that is the time between when voltage is first applied and the pintle is at the open position.

The arrangement of the devices, parts, or components described above is such that in one embodiment, when no magnetic field is being generated by the coil 40, the armature 20 is not urged in any particular direction. In another embodiment, the first magnetic circuit device 34 may be formed of a ferromagnetic material. As used herein, ferromagnetic means that the material can possess a spontaneous magnetization in the absence of an applied magnetic field and so may continue to exhibit a magnetic field after the coil 40 stops generating a magnetic field. That is following a period of time when the coil current is present for an injection period. As such, the first material may be selected to have a magnetic remanence characteristic such that the first magnetic circuit device has sufficient residual magnetism to hold the armature against the first stop when the current is returned to zero following the injection period. For this embodiment, when no magnetic field is being generated by the coil 40, the armature 20 is urged toward the first stop 22. Such an arrangement is advantageous in that it helps the armature 20 have the greatest distance to accelerate toward the pintle stop 28 and so maximizes the impact force of the armature 20 on the pintle stop 28. A spring 26 may be provided to urge the pintle 12 toward the closed position so that when no magnetic field is present, the ball 14 contacts the seat 16 to obstruct fuel 18 from flowing out of the fuel injector 10.

In one embodiment, the pintle closing force may be due solely to a fuel pressure of the fuel 18 acting on the pintle 12 and/or ball 14 to urge the pintle toward the closed position. In general, as the fuel pressure increases, the pintle closing force increases proportionately and so the force necessary to move the pintle 12 and/or ball 14 away from the closed position increases accordingly. In another embodiment, the pintle closing force may also be due to a spring force arising from a spring 26 acting on the pintle to urge the pintle toward the closed position. It will be appreciated that for some pintle/ball/seat configurations the spring load of the spring 26 may also need to increase as the fuel pressure increases to prevent leakage of the fuel 18 from within the fuel injector 10. Also, the spring rate may be increased if a faster injector closing time is desired.

It is advantageous for the force applied to the armature to have such a reversing characteristic because it assures that the armature 20 is in contact with the first stop, or at least is moved away from the pintle stop 28, prior to starting to move toward the pintle stop 28. The gap between the armature 20 and the pintle stop 28 allows the armature 20 to gain speed and thereby accumulate kinetic energy to supplement the static force generated by the magnetic field after the armature 20 contacts the pintle stop 28. By initially driving the armature 20 toward the first stop, it is unnecessary to provide a second spring that holds the armature 20 against the first stop 22 when the coil 40 is de-energized. As such, greater kinetic energy can be accumulated because the force of the second spring does not need to be overcome. The accumulated kinetic energy transferred from the armature 20 to the pintle 12 is then maximized to help to overcome the force from pressurized fuel holding the pintle 12 in the closed position.

Accordingly, a fuel injector 10 capable of operating at higher fuel pressures without increasing the overall size of the fuel injector is provided. The fuel injector 10 is configured so the armature 20 is spaced apart from the pintle stop 28 before an injection event is initiated. Such an arrangement allows the armature 20 to move and acquire kinetic energy before contacting the pintle stop 28. When the armature 20 contacts the pintle stop 28, the impact force from the kinetic energy is added to the static force from the magnetic field to help pull the pintle/ball assembly away from the seat 16. This combination of forces allows an existing pintle/ball/seat arrangement to be used at higher fuel pressures, without increasing the overall size of the fuel injector 10 to allow for a larger coil 40 capable of generating a stronger magnetic field. The amount of kinetic energy accumulated may be maximized by urging the armature 20 to be away from the pintle stop 28 before accelerating the armature toward the pintle stop 28. Moving the armature 20 away from the pintle stop 28 is accomplished by selecting shapes and materials used to form the first magnetic circuit device 34, second magnetic circuit devices 36, and the armature 20 so that when the magnetic field is first presented, the magnetic flux acting on the armature 20 is such that the armature 20 is first forced away from the pintle stop 28 before being urged toward the pintle stop 28. The armature position at the start of the injection event may also be established by forming the first magnetic circuit element 34 of ferromagnetic material and the armature 20 of an appropriate material so that there is a magnetic field attracting the armature 20 toward the first magnetic circuit element 34 when there is no magnetic field being generated by coil current in coil 40.

While this invention has been described in terms of the preferred embodiments thereof, it is not intended to be so limited, but rather only to the extent set forth in the claims that follow.

We claim:

1. A fuel injector comprising:

a pintle movable to a closed position that prevents fuel flow from the fuel injector, wherein the pintle is held in the closed position by a pintle closing force, and an open position that allows fuel flow from the fuel injector;

an armature movable between a first stop and a second stop, wherein the armature is slideably coupled to the pintle such that the armature contacts a pintle stop as the armature is urged from the first stop to the second stop to urge the pintle toward the open position, and the pintle is free to move to the closed position when the armature is not urged toward the second stop; and an electromagnetic circuit comprising the armature, a first magnetic circuit device, a second magnetic circuit device, and a coil configured to generate a magnetic field in response to a coil current, said electromagnetic circuit arranged such that the magnetic field present between the first magnetic circuit device and the second magnetic circuit device passes through the armature, wherein the first magnetic circuit device, the second magnetic circuit device, and the armature are configured so the magnetic field urges the armature toward the first stop during a time period following the initialization of the coil current, and urges the armature toward the second stop following the time period.

2. The fuel injector in accordance with claim 1, wherein a static force arising from the magnetic field and an impact force arising from the armature impacting the pintle stop while moving toward the second stop cooperate to generate a pintle opening force effective to overcome the pintle closing force and thereby move the pintle from the closed position to the open position.

3. The fuel injector in accordance with claim 1, wherein the static force is generated by the magnetic field acting on the armature.

4. The fuel injector in accordance with claim 1, wherein the fuel injector further comprises an air gap defined by the armature and the second stop such that the magnetic field present between the first magnetic circuit device and the second magnetic circuit device also passes through the gap.

5. The fuel injector in accordance with claim 1, wherein the first magnetic circuit device has a first device shape formed of a first material, the second magnetic circuit device has a second device shape formed of a second material, the armature has an armature shape formed of a third material, wherein the first device shape, the second device shape, the armature shape, the first material, the second material, and the third material are selected based on the pintle closing force.

6. The fuel injector in accordance with claim 5, wherein the pintle closing force comprises a fuel pressure force arising from fuel within the fuel injector acting on the pintle to urge the pintle toward the closed position.

7. The fuel injector in accordance with claim 6, wherein the pintle closing force further comprises a spring force arising from a spring acting on the pintle to urge the pintle toward the closed position.

8. The fuel injector in accordance with claim 5, wherein the fuel injector further comprises a housing encompassing the magnetic circuit, and the armature shape includes a main portion slideably guided by the pintle and a radial extension portion extending toward the housing and located between the first magnetic circuit device and the second magnetic circuit device.

9. The fuel injector in accordance with claim 8, wherein the radial extension portion has an extension longitudinal length selected based on a desired force urging the armature toward the first magnetic circuit device.

10. The fuel injector in accordance with claim 5, wherein the first material has a first permeability substantially greater than air, the second material has a second permeability substantially greater than air, and the third material has a third permeability substantially greater than air.

11. The fuel injector in accordance with claim 10, wherein the first material is ferromagnetic.

12. The fuel injector in accordance with claim 10, wherein the coil current is present for an injection period, and the first material is selected to have a magnetic remanence characteristic such that the first magnetic circuit device has sufficient residual magnetism to hold the armature against the first stop when the current is returned to zero following the injection period.

13. The fuel injector in accordance with claim 12, wherein the first material is four hundred (400) series martensitic stainless steel, the second material is twelve percent (12%) chrome ferritic stainless steel, and the third material is twelve percent (12%) chrome ferritic stainless steel.

14. The fuel injector in accordance with claim 1, wherein the first stop is provided by the first magnetic circuit device and the second stop is provided by the second magnetic circuit device.

15. The fuel injector in accordance with claim 14, wherein the fuel injector includes a housing that defines a longitudinal axis, and the first magnetic circuit device is a ring fixedly attached to the housing and coaxial with the longitudinal axis, said ring having a ring length selected based on the pintle closing force.

* * * * *